US008290176B1

(12) United States Patent
West

(10) Patent No.: US 8,290,176 B1
(45) Date of Patent: Oct. 16, 2012

(54) SPORTS TEAM NOVELTY SYSTEM FOR VEHICLES

(76) Inventor: Donald West, Alexander City, AL (US)

( * ) Notice: Subject to any disclaimer, the term of this patent is extended or adjusted under 35 U.S.C. 154(b) by 312 days.

(21) Appl. No.: 12/751,922

(22) Filed: Mar. 31, 2010

(51) Int. Cl.
*H04B 1/00* (2006.01)
*A63H 30/00* (2006.01)

(52) U.S. Cl. ..... 381/86; 446/454

(58) Field of Classification Search ..... 381/86; 704/272, 276; 280/1.201, 1.14, 1.165, 507; 446/71, 72, 454; 472/51, 56, 137
See application file for complete search history.

(56) References Cited

U.S. PATENT DOCUMENTS 4,635,039 A 1/1987 Gosswiller
5,397,866 A 3/1995 Lyons et al.
5,549,940 A * 8/1996 Noone ..... 428/31
6,037,679 A 3/2000 Pirillo
6,197,390 B1 3/2001 LaVite
6,288,633 B1 9/2001 Volpe et al.
6,582,314 B1 * 6/2003 Arehart ..... 472/51
6,769,951 B2 8/2004 Collier
D519,582 S 4/2006 Kim
8,091,915 B2 * 1/2012 Campbell et al. ..... 280/507
2004/0198169 A1 * 10/2004 Hornsby et al. ..... 446/454
2007/0124972 A1 * 6/2007 Ratcliffe ..... 40/591
2009/0018841 A1 * 1/2009 Leeds et al. ..... 704/272

* cited by examiner

*Primary Examiner* — Devona Faulk
*Assistant Examiner* — David Ton

(57) ABSTRACT

A novelty system for attaching to a vehicle featuring a first housing designed to resemble a front or a head of a mascot and a second housing designed to resemble a back portion or a tail of the mascot; means of attaching the housings to the front and rear of the vehicle, respectively; a speaker disposed in the first housing for emitting sounds such as animal sounds or fight songs; a motor disposed in the second housing for moving or rotating the second housing; and a remote control for controlling the first and second housings.

9 Claims, 5 Drawing Sheets

SPORTS TEAM NOVELTY SYSTEM FOR VEHICLES

FIELD OF THE INVENTION

The present invention is directed to a sports novelty item, more particularly to an electronic sports novelty item for mounting on a vehicle.

BACKGROUND OF THE INVENTION

Many fans want to support their favorite teams in any way possible. The present invention features a sports team novelty system for attaching to a vehicle, which allows a user to display support for his/her favorite team. The novelty system is designed to resemble an animal or mascot for a sports team.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
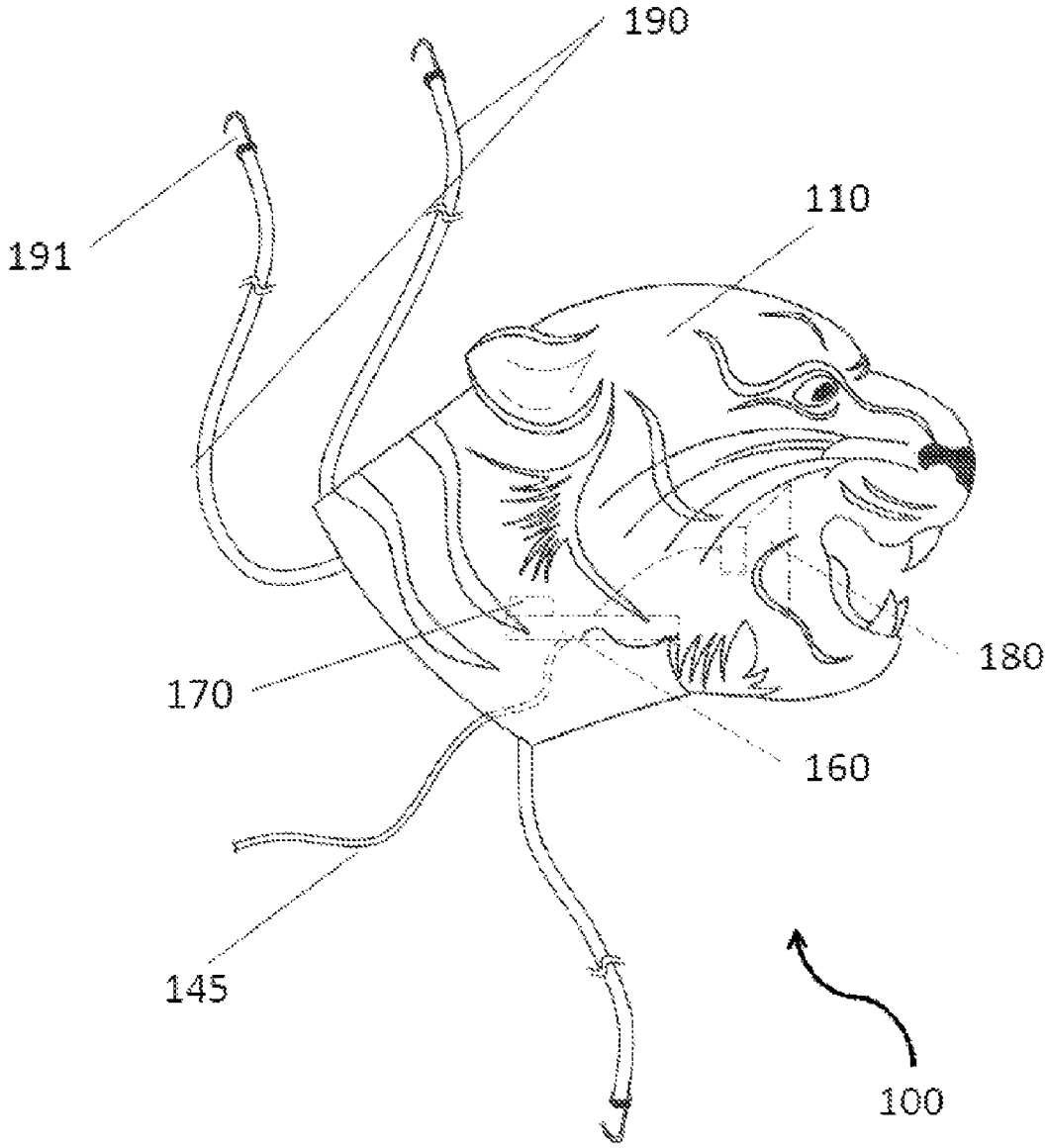
FIG. 1 is a side view of the first housing of the sports team novelty system of the present invention.
Figure 2:
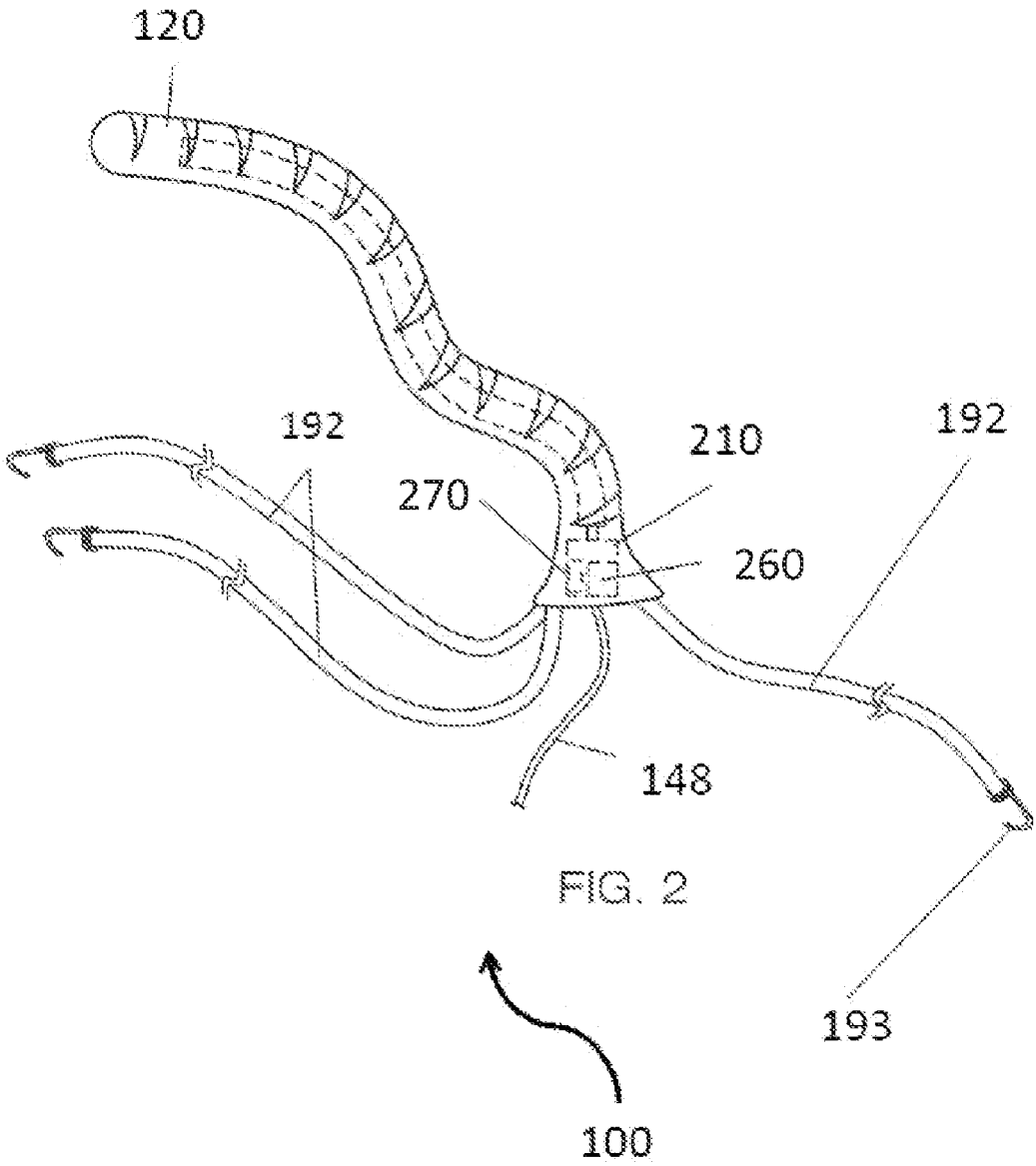
FIG. 2 is a top view of the second housing of the sports team novelty system of the present invention.
Figure 3:
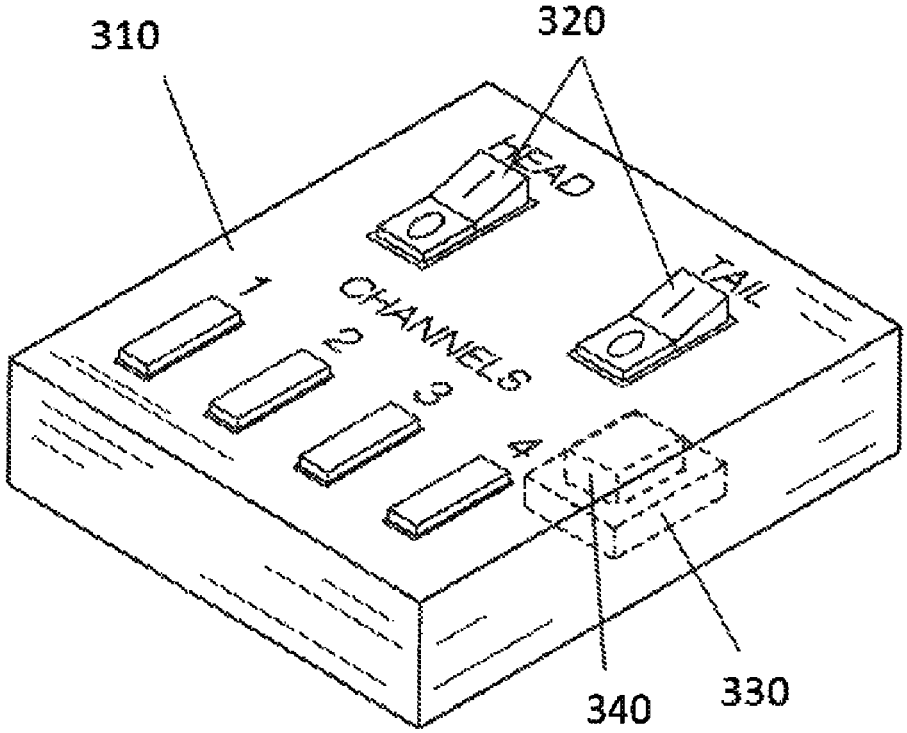
FIG. 3 is a perspective view of the remote control for the sports team novelty system of the present invention.
Figure 4:
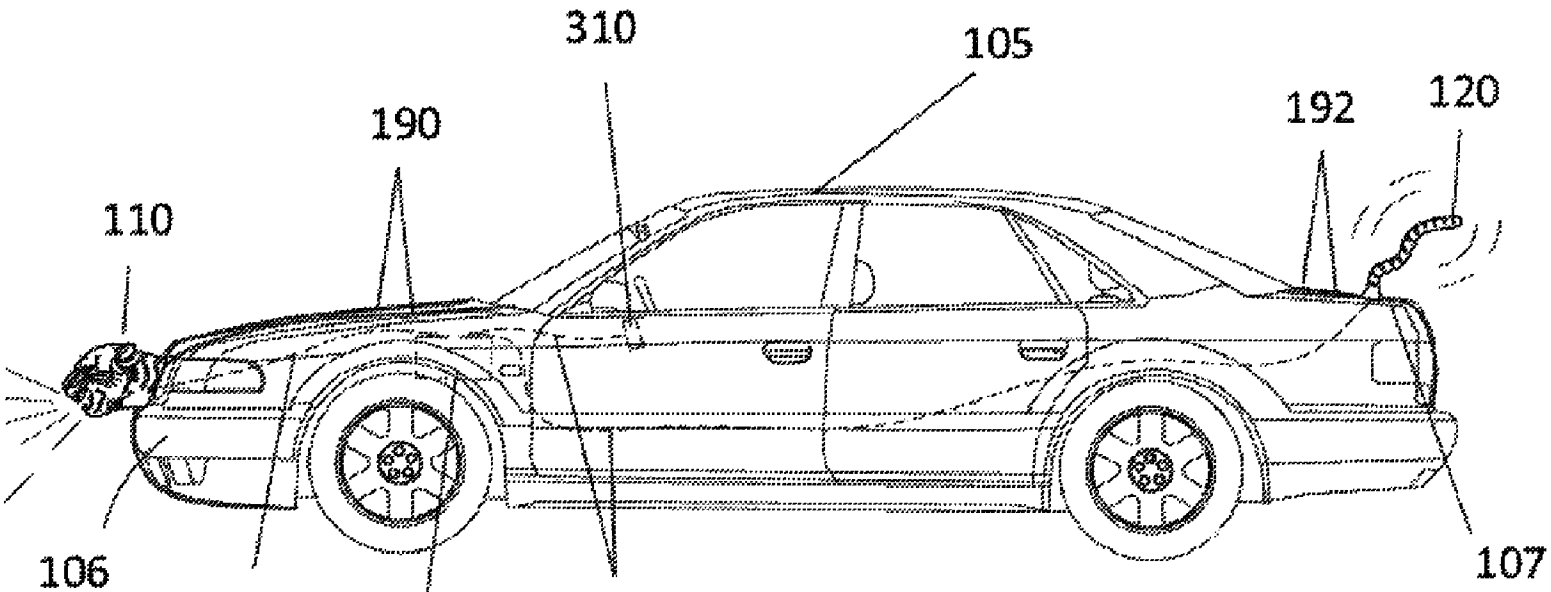
FIG. 4 is a side view of the sports team novelty system of the present invention as attached to a vehicle.

Referring now to FIGS. 1-5, the present invention features a sports team novelty system 100 for attaching to a vehicle 105. The novelty system 100 of the present invention allows a user to display support for his/her favorite team.

The novelty system 100 is designed to resemble an animal or mascot for a sports team. In some embodiments, the novelty system 100 resembles a tiger. In some embodiments, the novelty system resembles another animal or mascot such as a hornet, a bulldog, an eagle, a wildcat, a cougar, a falcon, a devil, a wolf, a Trojan, or the like.

The novelty system 100 comprises a first housing 110, which is designed to resemble the front or head part of the animal or mascot (e.g., a tiger head, an eagle head, a hornet head). The first housing 110 is for installing on the front 106 of a vehicle 105. In some embodiments, the first housing 110 is attached to the front 106 of a vehicle 105 via one or more first straps 190 (e.g., elastic straps), for example with first hooks 191.

The novelty system 100 of the present invention further comprises a second housing 120 designed to resemble the back portion or tail of the animal or mascot (e.g., tiger tail, eagle tail, hornet stinger). The second housing 120 is for attaching to the rear 107 of a vehicle 105. In some embodiments, the second housing 120 is attached to the rear 107 of the vehicle 105 via one or more second straps 192 (e.g., elastic straps), for example with second hooks 193.

Disposed inside the first housing 110 is a first microprocessor 160. A speaker 180 is disposed on the housing 110 and is operatively connected to the first microprocessor 160. The system 100 also comprises a first receiver operatively connected to the first microprocessor 160. The first microprocessor 160 comprises a memory component (e.g., random access memory, flash memory) programmed with various sounds, for example sounds such as sounds of animals (e.g., tiger roar) and/or songs such as fight songs for teams. When the speaker 180 is activated, it emits the sound accordingly.

The first microprocessor 160 and/or speaker 180 and/or first receiver are operatively connected to a power source. In some embodiments, the power source is an electrical system of the vehicle 149 or a battery. In some embodiments, the microprocessor 160 and/or speaker 180 and/or first receiver 170 are operatively connected to the electrical system of the vehicle 149 via first wiring 145.

A motor 210 and a second receiver 270 are both disposed inside the second housing 120. The motor 210 (when activated) functions to cause the second housing 120 to move or rotate (e.g., if the second housing 120 is a tiger tail, the tiger tail can be made to wag). Such motors are well known to one of ordinary skill in the art. A second microprocessor 260 is operatively connected to the motor 210 and the second receiver.

The second microprocessor 260 and/or motor 210 and/or second receiver 270 are operatively connected to a power source. In some embodiments, the power source is an electrical system of the vehicle 149 or a battery. In some embodiments, the second microprocessor 260 and/or motor 210 and/or second receiver 270 are operatively connected to the electrical system of the vehicle 149 via second wiring 148.

The novelty system 100 the present invention further comprises a remote control 310, which allows a user to operate the system 100 while inside the vehicle 105. Disposed inside the remote control 310 are a third microprocessor 340 and a transmitter 330, wherein the transmitter 330 is operatively connected to the third microprocessor.

A plurality of control buttons 320 for operating the first housing 110 and/or the second housing 120 are disposed on the remote control 310. For example, a first housing button may function to control the first housing 110 and a second housing button may function to control the second housing 120. The control buttons 320 may each be operatively connected to the third microprocessor. Control buttons 320 are well known to one of ordinary skill in the art.

The third microprocessor is configured to receive a first input signal from the first housing button when the first housing button is pressed. Upon receipt of the first input signal, the third microprocessor is configured to generate a first output command to the transmitter 330 to cause the transmitter 330 to emit a first transmitter signal to the first receiver.

The first microprocessor 160 is configured to receive a first receiver input signal from the first receiver when the first receiver receives the first transmitter signal from the transmitter. Upon receipt of the first receiver input signal the first microprocessor 160 is configured to generate a speaker output command to the speaker 180 to cause the speaker 180 to emit a sound.

The third microprocessor is configured to receive a second input signal from the second housing button when the second housing button is pressed. Upon receipt of the second input signal, the third microprocessor is configured to generate a second output command to the transmitter 330 to cause the transmitter 330 to emit a second transmitter signal to the second receiver.

The second microprocessor 170 is configured to receive a second receiver input signal from the second receiver when the second receiver receives the second transmitter signal from the transmitter. Upon receipt of the second receiver input signal the second microprocessor 170 is configured to generate a motor output command to the motor 210 cause the motor 210 to move the second housing 210.

In some embodiments, the third microprocessor and/or the transmitter 330 are operatively connected to a power source. In some embodiments, the power source is an electrical system of the vehicle 149 or a battery. In some embodiments, the third microprocessor and/or the transmitter 330 are operatively connected to the electrical system of the vehicle 149 via third wiring 147.

Figure 5:
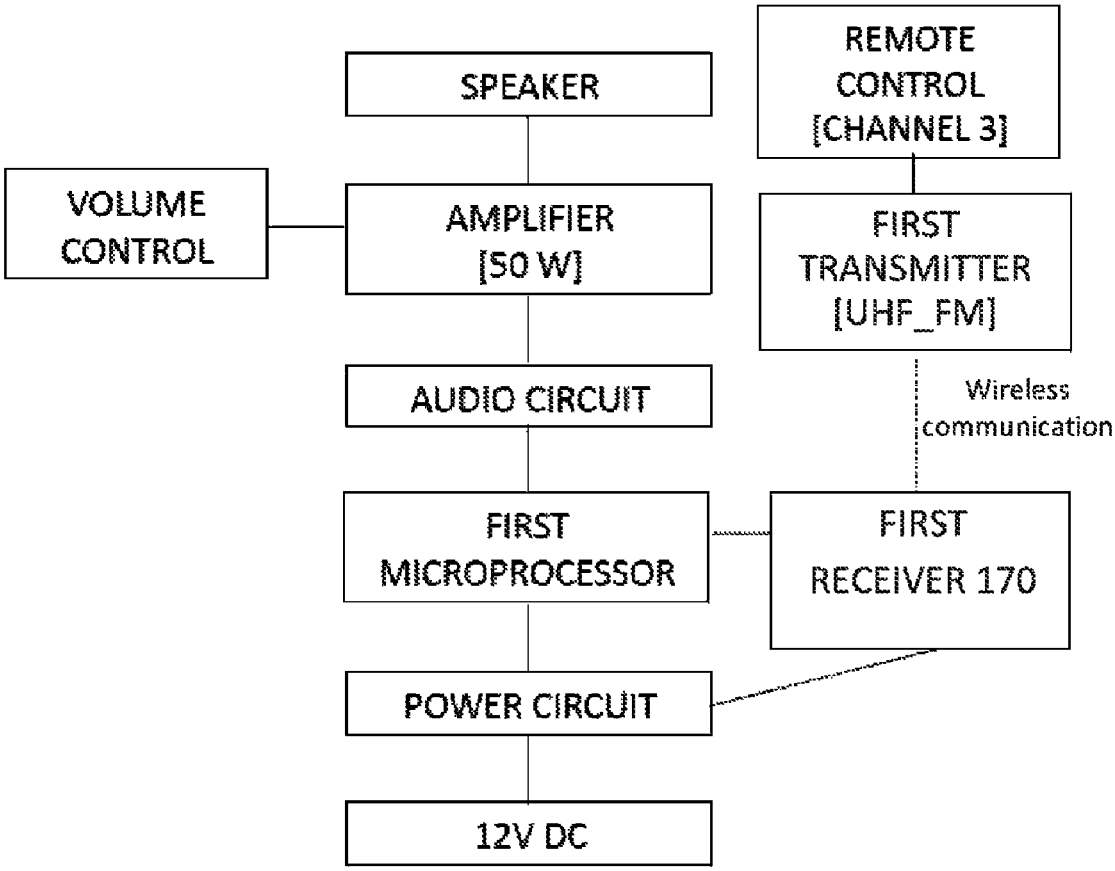
FIG. 5 is a block representation of the electrical components of the novelty system of the present invention.

Referring now to FIG. 5, the microprocessor stores all information for the first housing 110 (e.g., sounds such as tiger roar, fight songs, etc.). An audio circuit may supply the information to an amplifier (e.g., a 50 W amplifier), which is then fed to the speaker. In some embodiments, the amplifier comprises volume control. The transmitter may be a UHF-FM transmitter. The 12V DC vehicle power supply may provide regulated power supply with a quick disconnect plug from the car battery.

The first housing 110 and/or the second housing 120 may be constructed in a variety of sizes. In some embodiments, the first housing 110 is between about 5 to inches tall as measured from the top end 113 to the bottom end 114. In some embodiments, the first housing 110 is between about 10 to 15 inches tall as measured from the top end 113 to the bottom end 114. In some embodiments, the first housing 110 is more than about 15 inches tall.

In some embodiments, the first housing 110 is between about 5 to 10 inches long as measured from the first side end 111 to the second side end 112. In some embodiments, the first housing 110 is between about 10 to 15 inches long as measured from the first side end 111 to the second side end 112. In some embodiments, the first housing 110 is more than about 15 inches long.

in some embodiments, the first housing 110 is between about 5 to 10 inches wide as measured from the front end 115 to the back end 116. In some embodiments, the first housing 110 is between about 10 to 15 inches wide as measured from the front end 115 to the back end 116. In some embodiments, the first housing 110 is more than about 15 inches wide.

As used herein, the term "about" refers to plus or minus 10% of the referenced number. For example, an embodiment wherein the first housing 111 is about 10 inches wide includes a first housing 111 that is between 9 and 11 inches wide.

The following the disclosures of the following U.S. Patents are incorporated in their entirety by reference herein: U.S. Pat. No. 6,197,390; U.S. Pat. No. 6,769,951; U.S. Pat. No. 6,037,679; U.S. Pat. No. 4,635,039; U.S. Pat. No. 6,288,633; U.S. Pat. No. 5,397,866; U.S. Pat. Application No. 2007/0124972; U.S. Pat. Application No. 2006/0001284.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A novelty system for attaching to a vehicle, said novelty system comprising:

(a) a first housing designed to resemble a front or a head of a mascot and a second housing designed to resemble a back portion or a tail of the mascot;

(b) at least one first strap disposed on the first housing for attaching the first housing to a front of a vehicle and at least one second strap disposed on the second housing for attaching the second housing to a rear of the vehicle;

(c) a first microprocessor, a speaker, and a first receiver each disposed inside the first housing, the speaker and the first receiver are each operatively connected to the first microprocessor, wherein the first microprocessor comprises a memory component programmed with a plurality of sounds;

(d) a second microprocessor, a motor, and a second receiver each disposed in the second housing, the motor and the second receiver are each operatively connected to the second microprocessor, the motor functions to cause the second housing to move or rotate;

(c) a remote control, wherein a first housing button for controlling the first housing and a second housing button for controlling the second housing are each disposed on the remote control; and (f) a third microprocessor and a transmitter each disposed in the remote control, wherein the transmitter, the first housing button, and the second housing button are each operatively connected to the third microprocessor;

wherein third microprocessor is configured to receive a first input signal from the first housing button when the first housing button is pressed, wherein upon receipt of the first input signal, the third microprocessor is configured to generate a first output command to the transmitter to cause the transmitter to emit a first transmitter signal to the first receiver;

wherein the first microprocessor is configured to receive a first receiver input signal from the first receiver when the first receiver receives the first transmitter signal from the transmitter, wherein upon receipt of the first receiver input signal the first microprocessor is configured to generate a speaker output command to the speaker to cause the speaker to emit a sound;

wherein the third microprocessor is configured to receive a second input signal from the second housing button when the second housing button is pressed, wherein upon receipt of the second input signal, the third microprocessor is configured to generate a second output command to the transmitter to cause the transmitter to emit a second transmitter signal to the second receiver;

and wherein the second microprocessor is configured to receive a second receiver input signal from the second receiver when the second receiver receives the second transmitter signal from the transmitter, wherein upon receipt of the second receiver input signal the second microprocessor is configured to generate a motor output command to the motor cause the motor to move the second housing.

2. The novelty system of claim 1, wherein the mascot is a tiger, a hornet, a bulldog, an eagle, a wildcat, a cougar, a falcon, a devil, a wolf, or a Trojan.

3. The novelty system of claim 1, wherein the memory component is random access memory or flash memory.

4. The novelty system of claim 1, wherein the sounds include animal sounds and songs.

5. The novelty system of claim 1 further comprising an amplifier operatively connected to both the microprocessor and to the speaker.

6. The novelty system of claim 5, wherein the amplifier comprises volume control.

7. The novelty system of claim 1, wherein the transmitter is a UHF-FM transmitter.

8. The novelty system of claim 1, wherein the first microprocessor, the second microprocessor, the third microprocessor, the speaker, the motor, the first receiver, the second receiver, or the transmitter is operatively connected to a power source.

9. The novelty system of claim 8, wherein the power source is an electrical system of the vehicle or a battery.

* * * * *